US007628160B2

(12) United States Patent
Winup

(10) Patent No.: US 7,628,160 B2
(45) Date of Patent: Dec. 8, 2009

(54) TOOL AND APPARATUS FOR USE IN HAIR COLORING AND OTHER TREATMENTS

(76) Inventor: Karen S. Winup, 204 Chalcocite, Tyrone, NM (US) 88065

( * ) Notice: Subject to any disclaimer, the term of this patent is extended or adjusted under 35 U.S.C. 154(b) by 44 days.

(21) Appl. No.: 11/447,912

(22) Filed: Jun. 7, 2006

(65) Prior Publication Data

US 2006/0278250 A1 Dec. 14, 2006

Related U.S. Application Data

(60) Provisional application No. 60/689,263, filed on Jun. 9, 2005.

(51) Int. Cl.
*A45D 24/00* (2006.01)

(52) U.S. Cl. ..... 132/124; 132/148; 132/150

(58) Field of Classification Search ..... 132/208, 132/219, 120, 149, 150, 159, 270, 141, 139, 132/160; D28/21, 22, 29, 30, 31
See application file for complete search history.

(56) References Cited

U.S. PATENT DOCUMENTS

| | | | | | |
|---|---|---|---|---|---|
| 3,349,781 | A | | 10/1967 | Poodle et al. | |
| 4,224,954 | A | | 9/1980 | Stahl | |
| D297,177 | S | * | 8/1988 | Smith et al. | D28/30 |
| 4,880,019 | A | | 11/1989 | Roubo | |
| 5,156,172 | A | | 10/1992 | Tancredi | |
| 5,231,999 | A | * | 8/1993 | Schroettner | 132/137 |
| 5,287,864 | A | | 2/1994 | Gallo | |
| 5,335,679 | A | | 8/1994 | Baxter | |
| 5,349,970 | A | | 9/1994 | Razzouq | |
| 5,433,225 | A | * | 7/1995 | Liggett et al. | 132/208 |
| D363,364 | S | * | 10/1995 | Newman | D28/28 |
| D377,236 | S | * | 1/1997 | Nevarez | D28/21 |
| 5,816,268 | A | | 10/1998 | Awaijane | |
| 2003/0024043 | A1 | * | 2/2003 | Rivera et al. | 4/654 |

FOREIGN PATENT DOCUMENTS

| | | |
|---|---|---|
| GB | 2 234 758 A | 2/1991 |

* cited by examiner

*Primary Examiner*—Robyn Doan
*Assistant Examiner*—Rachel R Steitz
(74) *Attorney, Agent, or Firm*—Nixon & Vanderhye

(57) ABSTRACT

A tool for use in a hair color or other treatment foiling method, comprising an elongated panel at one end of the tool for supporting foil and hair during a coloring procedure or other treatment. The panel comprises a comb portion on one side thereof with a curved tooth at the end of the panel adjacent to the comb portion. A handle portion is secured to the panel and is tapered inwardly toward the other end of the tool. An elongated pick extends outwardly from the handle portion at the other end of the tool for separating, weaving and preparing hair to be colored or treated. In the method of the present invention, the tool is used with a hair coloring or treatment tool kit comprising a flexible support such as an apron having a plurality of pockets for removably supporting all of the components required for performing a hair color foiling method or other hair treatment.

8 Claims, 2 Drawing Sheets

TOOL AND APPARATUS FOR USE IN HAIR COLORING AND OTHER TREATMENTS

CROSS-REFERENCES TO RELATED APPLICATIONS

This application claims the priority of Provisional Patent Application No. 60/689,263 filed on Jun. 9, 2005.

STATEMENT REGARDING FEDERALLY SPONSORED RESEARCH OR DEVELOPMENT

Not applicable.

BACKGROUND OF THE INVENTION

1. Field of the Invention

The present invention relates to a tool and apparatus for use in the coloring or other treatment of hair and, more particularly, to such a tool and apparatus for use in hair coloring or other treatment with the use of foil.

2. Description of the Background Art

High lighting, low lighting, panels, blocks and frosting hair are some of the most profitable markets in the professional cosmetology industry. Foil coloring is a technique used in hair salons, beauty schools, platform artistry and education many times over on a day to day basis. In the simplest situation, a foil is used without the aid of any support apparatus. Many times this yields unprofessional and inconsistent results. "Home-made" foiling devices developed for use in the professional hair industry may cause many problems, one being the problem of sanitation. These devices made the "professional job" of foil coloring look unprofessional.

The tools needed to do the job of foil coloring are many and the job of foil coloring is difficult at best. Many professionals employ apprentices or use tables and/or roll-a-bouts as helpers thus adding more cost to the salon, the salon worker and ultimately to the salon client. The technology of foil coloring has become more difficult in recent times. The hair industry and the hair client demand better foiling results. Television and magazines demonstrate models with hair styles the "average" salon worker can not or are not equipped to duplicate. It is imperative to perform with high quality in the professional hair industry. Neither prior art or home made devices present the tools or methods needed to achieve such high expectations or results.

The professional hair industry worker must manage one dimensional coloring just as easily as managing three or four dimensional colors. Today's methods and tools are old fashioned, difficult and unstable. Prior art technology has been unsuccessful in fulfilling the needs for professional foil coloring for over twenty years.

Prior art devices have proven to be out dated, hard to use and/or inadequate. Many of these tools are not designed with consideration of the complexity presented by foil coloring. It is important to be able to manipulate tools easily and ergonomically. The prior art is based on a theory of reaching horizontally for objects needed during the foil coloring process. The present invention is based on a "vertical theory" of reaching up and down for tools on a wearable tool kit, using a new and improved ergonomic foiling tool and a method of foiling that enables all levels of hair industry workers to achieve consistent and positive results every time.

SUMMARY OF THE INVENTION

The present invention is directed to a new and improved specialty foiling tool and tool kit for use in hair foil coloring, chemical treatment and the like.

The tool may be constructed of any suitable non-porous material, such as plastic, rubber or carbon, and generally comprises a substantially rectangular panel at one end thereof that merges with an inwardly tapered handle portion at the other end thereof. A narrow elongated pick extends outwardly from the end of the handle portion at the other end of the tool. The handle portion has a tapered shape that facilities the gripping and support of the tool during its use. The handle portion may be provided with recessed areas on both sides thereof to further facilitate the gripping of the tool.

The outer end portion of the panel has an inwardly tapered or double beveled edge portion to facilitate its placement, with foil folded there over, close to the scalp under portions of hair to be colored. One side of the panel has a comb portion that terminates at the outer end thereof in a curved tooth for separating portions of hair during the coloring or treatment process.

The handle portion is of a thickness that is greater than that of the panel so as to provide a lip on both sides of the tool near the inner end of the comb portion. The lip may be curved downwardly and inwardly to facilitate the folding of foil placed on the tool. Also the lip may be beveled inwardly at an angle of approximately 35°-45°.

The tool is constructed to perform many of the functions required for the coloring or other treatment of hair by the foiling method. For example, the curved tooth is used to section portions of the hair, the pick is used to weave through sections of the hair to separate portions to be colored, the comb is used to comb and straighten portions of the hair to be treated, the panel is used to support foil and portions of hair to be treated thereon, and the lip facilitates the folding of the foil on the hair during the color process or other treatment.

The present invention is also directed to a hair coloring or treatment kit in the form of an apron or other flexible support having pockets including all of the components required for the coloring of hair by the foil method or other hair treatment. The construction and contents of the kit are described more specifically hereinafter.

DETAILED DESCRIPTION OF THE INVENTION

Figure 1:
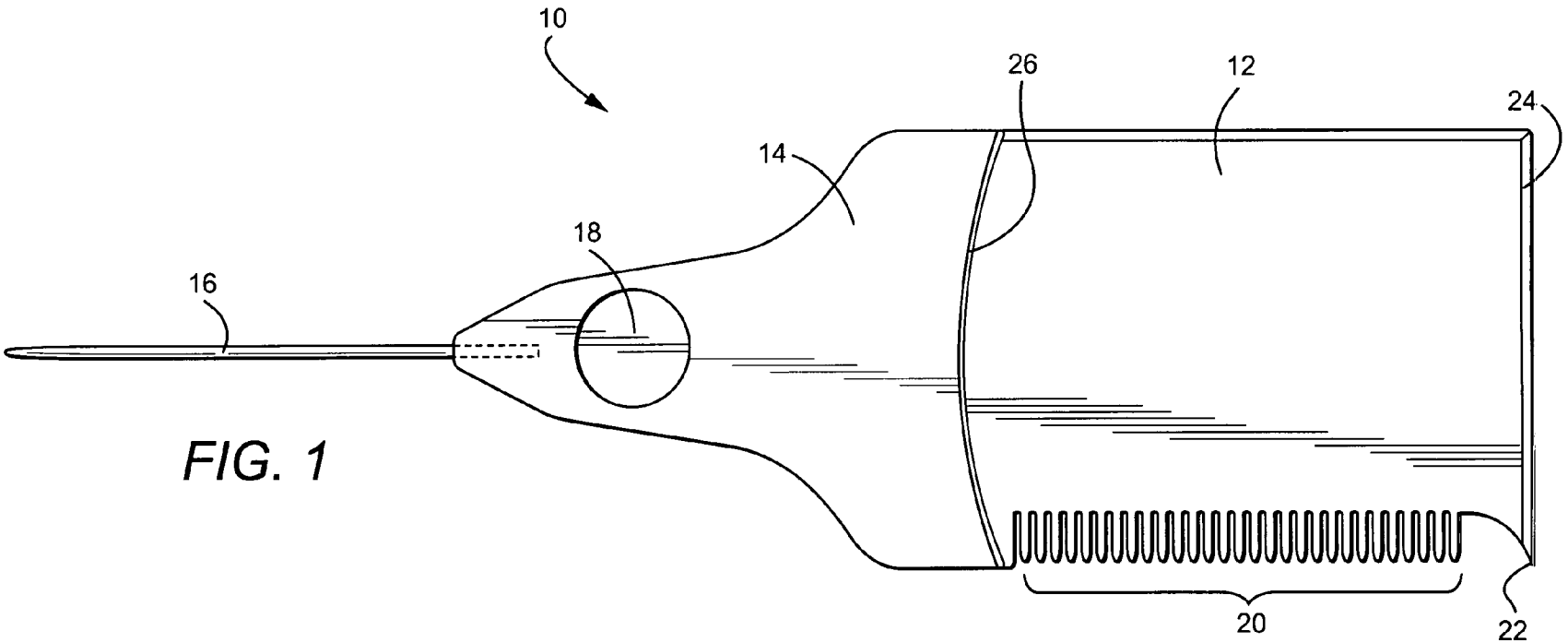
FIG. 1 is a front elevational view of the foiling tool of the present invention.
Figure 2:
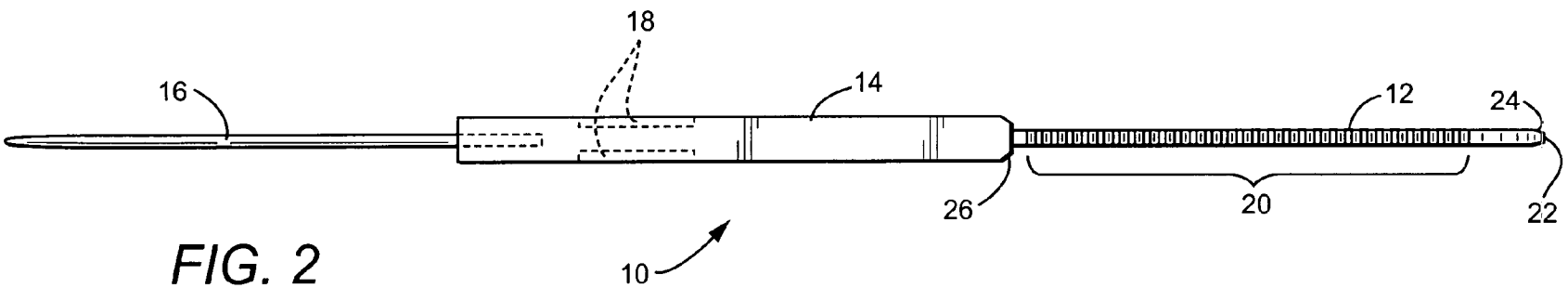
FIG. 2 is a side elevational view of the foiling tool shown in FIG. 1.

Referring to FIGS. 1 and 2, the hair foiling tool 10 of the present invention generally comprises a substantially rectangular panel 12 at one end thereof which merges into an inwardly tapered handle portion 14 at the other end thereof. The tool may be formed of any suitable non-porous material, such as plastic, rubber or carbon.

A narrow elongated pick 16 extends outwardly from the handle portion 14 at the other end of the tool 10, and may be formed of any suitable material such as metal or plastic. The pick 16 may be of any suitable length, e.g., 3-4 inches.

The handle portion 14 is of a size and tapered shape to be easily gripped by a person using the tool 10. The handle portion may be formed with a recessed finger rest portion 18 on both sides thereof which may be of any suitable shape, such as circular.

One side edge of the panel 12 is formed with a comb portion 20 that terminates in a curved tooth 22 at the outer end thereof.

The comb portion 20 may be of any suitable length or shape. As shown in FIG. 2, the outer edge portion of the panel 12 may have a double beveled edge 24.

The handle portion 14 is of greater thickness than the panel 12 so as to provide a lip 26 at the inner edge of the handle portion 14 on both sides of the tool 10. The lip 26 may be of any suitable size and shape, and preferably, is curved outwardly in a direction away from the outer edge portion of the panel 12, as shown in FIG. 1 and has an inwardly beveled edge as shown in FIG. 2.

The tool 10 may be constructed in any suitable manner. For example, it may be formed of one piece construction or of multiple parts that are assembled together.

The tool 10 may be used to perform various functions during a hair color foiling operation, hair straightening or other treatment. For example, the curved tooth 22 of the panel 12 may be used to separate or section portions of hair to be colored or treated, the pick 16 may be used to weave through a separated section of hair to separate portions thereof to be colored or treated and also may be used to facilitate the folding of foil used in the coloring or other operation; the comb portion 20 may be used to comb and straighten portions of hair to be colored or treated; the panel 12 may be used to support foil thereon on which hair is placed to be colored or treated, and the lip 26 serves to facilitate the folding of foil over the hair thereon after the coloring or other operation is completed. The curved shape of the lip 26 further facilitates the folding of the foil and the depth thereof provides ample room for extra product and hair once the foil is folded.

The beveled outer edge 24 of the panel 12 facilitates the placement of the panel with foil folded thereover, close to the scalp, under the hair to be colored or treated.

It will be readily seen, therefore, that the new and improved foiling tool 10 of the present invention performs many functions in a hair color foiling or other operation which have required many separate components in the past. Also, the tool 10 is of a size and shape to be easily handled by the person performing the hair coloring operation or other treatment.

Figure 3:
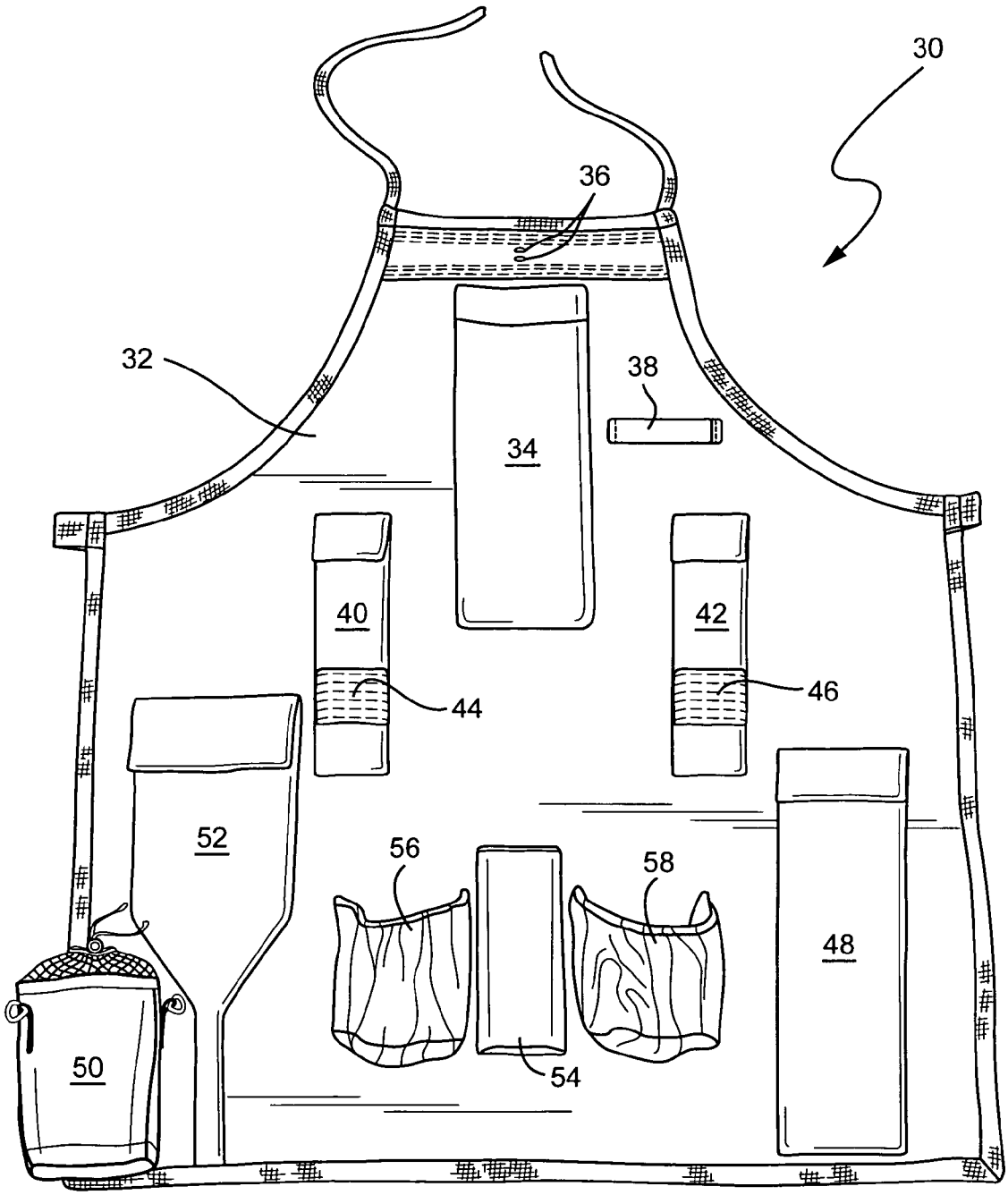
FIG. 3 is a front elevational view of the apron or other flexible support for the hair coloring or other treatment tool kit of the present invention.

A second aspect of the present invention involves a kit 30 shown in FIG. 3 which includes all of the components for performing a hair color foiling or other operation for use with the tool 10. As shown in FIG. 3, the kit 30 comprises an apron 32 or other flexible support which includes pockets and/or compartments for supporting all components of the hair color foiling or other operation, including the tool 10. For example, the apron 32 may include an elongated pocket 34 for foils and a foil clip holder 36 or the like located in the upper mid portion thereof; a cleansing cloth holder 38, a pair of pockets 40, 42 on both sides of the lower portion of the foil pocket 34 for holding coloring or treatment brushes and the like. Each of the pockets, 40, 42 may be provided with outer belt portions 44, 46 for supporting hair clips or the like. The lower portion of the apron 32 on one side thereof may be provided with a pocket 48 for storing extra foils. On the other side of the apron 32, a pocket 50 may be provided at the lower end thereof for supporting a container for water or another liquid or the like. An elongated fitted pocket 52 may be provided generally between the hair brush pocket 40 and liquid container pocket 50 for supporting the foiling tool 10 of the present invention. A pocket 54 is provided at the lower end of the apron in the mid-portion thereof for supporting a hair color or other chemical bottle, and pockets 56, 58 are provided on both sides of the hair color bottle pocket 54 for supporting color or chemical bowls.

As an illustrative embodiment, one method of use of the foiling tool 10 and color or treatment kit 30 is as follows:

1. Remove color bowls and color bottle from the pockets 54, 56, 58 of the tool kit apron.
2. Mix desired formulas of colors and/or bleach or other chemicals into each applicator.
3. Place color bowls and bottle back into appropriate pockets on the apron.
4. Dampen hair slightly with product contained in bottle in pocket 50.
5. Remove the tool 10 from pocket 52.
6. Use the comb portion 20 to smooth and untangle hair.
7. Part hair into sections using either the curved tooth 22 or the pick 16 to part off a slice of hair to be woven.
8. Weave the sectioned slice of hair with the pick 16.
9. Pinch the strands with fingers.
10. Smooth the strands with the comb portion 20 if needed.
11. While holding the tool 10 and the strands in one hand, use the other to grasp the foil from the pocket 34.
12. Place the foil onto the panel 12 of the tool 10.
13. While the strands and tool 10 are in one hand, snuggly cup the foil edge over the double beveled edge of the panel 12.
14. Place the tool 10 with the foil in place into the opposite hand.
15. Place the panel 12 with foil underneath the woven strands.
16. Place thumb or hand ¾ the way down the length of the hair holding strand tightly.
17. Tilt the panel 12 slightly down to feel a snug fit and maintain tension on the panel 12 at the scalp.
18. Apply color or chemical to strands of hair using appropriate tools and chemicals on the apron.
19. Once enough color or other product is applied, either run the brush, another tool or a finger across the curved lip 26 of the foiled tool 10 to create a foiling arch.
20. Place one finger under the folded arch and start to fold in half.
21. Once the foil is folded, secure by swiping or sliding the hand quickly across the top of the folded foil.
22. Fold extra foil down upon itself.
23. Check beneath the folded foil and adjust the folded foil alignment if necessary.
24. Place and secure the foiled hair strands with a clip.

After the color or other service is finished, the tool 10 may be placed into the specially designed pocket 52 on the apron 32. All of the other components may then be returned to their pockets in the apron 32 and the kit 30 may be placed in a carry bag or the like (not shown).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A tool for use in a hair color or other treatment foiling method, comprising:

an elongated flat panel at one end of the tool for supporting foil and hair during a coloring or treatment procedure, said panel having a straight outer edge at one end thereof to enable foil to be folded thereover near a scalp of a person whose hair is being colored or treated;

said panel comprising a comb portion on one side edge thereof that is substantially perpendicular to said outer end edge;

a handle portion secured to said panel at an end of said panel opposite to said one end thereof and being of the same width as said panel at a point adjacent thereto, said handle portion being tapered inwardly toward said end of the tool opposite to said one end thereof; and an elongated pick extending outwardly from said handle portion at said opposite end of the tool for separating and weaving hair to be colored or treated;

said handle portion being of greater thickness than said panel to provide a folding lip on both sides of the tool extending across a junction of said panel and said handle portion, said folding lip being of the same width as the adjacent portion of said panel and serving to facilitate the folding of a foil placed on said panel during a hair coloring or treatment procedure, said folding lip being curved with the center portion thereof extending in a direction away from said one end of said panel in a concave manner to enable a central pocket area to be formed in a folded foil for receiving and retaining therein hair and any excess hair coloring or treatment product.

2. The tool of claim 1 wherein said panel is of a generally rectangular shape.

3. The tool of claim 1 wherein the outer edge of said panel at the one end of the tool is of a double beveled shape.

4. The tool of claim 1 wherein said handle portion comprises recessed finger portions on both sides thereof to facilitate the gripping of the handle portion.

5. The tool of claim 1 wherein an edge of said folding lip is beveled inwardly toward said one end of said panel.

6. The tool of claim 1 which is formed of one piece construction.

7. The tool of claim 1 wherein said panel, said handle portion and said pick are separate parts that are secured together.

8. The tool of claim 1 wherein said comb portion is of less length than a length of said one side edge of said panel so that one end of said comb portion is in spaced relation to the outer edge of said panel at said one end of the tool; and said one side edge of said panel is curved laterally outwardly from the end of said comb portion toward said one end of said panel to define a tooth terminating at said one end of said panel in spaced relation to the one end of said comb portion for separating or sectioning portions of hair to be colored or treated.

* * * * *